US005437089A

United States Patent [19]

Salganik et al.

[11] Patent Number: 5,437,089

[45] Date of Patent: Aug. 1, 1995

[54] METHOD AND APPARATUS FOR CONTINUOUS PRODUCTION HOT-ROLLED STRIPS

[75] Inventors: Viktor M. Salganik; Aanatoly I. Starkov; Igor G. Gun; Alexandr V. Povarich; Leonid B. Idelchik, all of Magnitogorsk, Russian Federation

[73] Assignee: Magnitogorsky Metallurgichesky Kombinat Imeni V.I. Lenina, Magnitogorsk, Russian Federation

[21] Appl. No.: 976,975

[22] PCT Filed: Apr. 16, 1992

[86] PCT No.: PCT/RU92/00079

§ 371 Date: Jan. 28, 1993

§ 102(e) Date: Jan. 28, 1993

[87] PCT Pub. No.: WO92/18262

PCT Pub. Date: Oct. 29, 1992

[30] Foreign Application Priority Data

Apr. 17, 1991 [RU] Russian Federation ..... 4927522

[51] Int. Cl.[6] ..... B21B 1/46; B21B 13/22

[52] U.S. Cl. ..... 29/527.7; 29/33 C; 72/229; 72/240

[58] Field of Search ..... 29/527.7, 33 C; 72/229, 72/240

[56] References Cited

U.S. PATENT DOCUMENTS

| | | | |
|---|---|---|---|
| 4,630,352 | 12/1986 | Ginzburg . | |
| 4,698,897 | 10/1987 | Formmann et al. | 29/527.7 |
| 4,793,169 | 12/1988 | Ginzburg . | |
| 4,976,024 | 12/1990 | Kimura | 29/527.7 X |
| 5,150,597 | 9/1992 | Sekiya et al. | 29/527.7 X |
| 5,212,856 | 5/1993 | Guisto et al. | 29/527.7 X |

FOREIGN PATENT DOCUMENTS

| | | | |
|---|---|---|---|
| 320846 | 6/1989 | European Pat. Off. | 29/527.7 |
| 972603 | 9/1951 | Germany . | |
| 3816496 | 11/1989 | Germany | 29/527.7 |
| 58-100904 | 2/1983 | Japan | 29/527.7 |
| 58-100903 | 6/1983 | Japan | 29/527.7 |
| 62-89502 | 4/1987 | Japan | 29/527.7 |
| 2097702 | 5/1987 | Japan | 29/527.7 |
| 89/08512 | 9/1989 | WIPO | 29/33 C |
| 92/18262 | 10/1992 | WIPO | 29/527.7 |

*Primary Examiner*—Carl J. Arbes
*Attorney, Agent, or Firm*—Lilling & Lilling

[57] ABSTRACT

A method for continuous production of hot-rolled strips is used at metal works and involves continuously casting a thin slab which is stored and rolled into a strip in the form of individual portions in several runs with return into the storage zone and with subsequent cooling, cutting, and coiling. The slab and the returned portion are stored simultaneously by combined coiling into an intermediate coil which is moved along the storage zone during coiling and during uncoiling of the portion of the slab and strip being rolled.

An apparatus for carrying out the method has roller-hearth furnace, a storage in the form of a carriage provided outside the roller-hearth furnace for movement therealong, and a means for forming an intermediate coil from the slab and from the returned portion of the strip. The means for forming is installed on the carriage in the furnace so that the intermediate coil can move over rollers of the furnace during coiling and uncoiling.

6 Claims, 6 Drawing Sheets

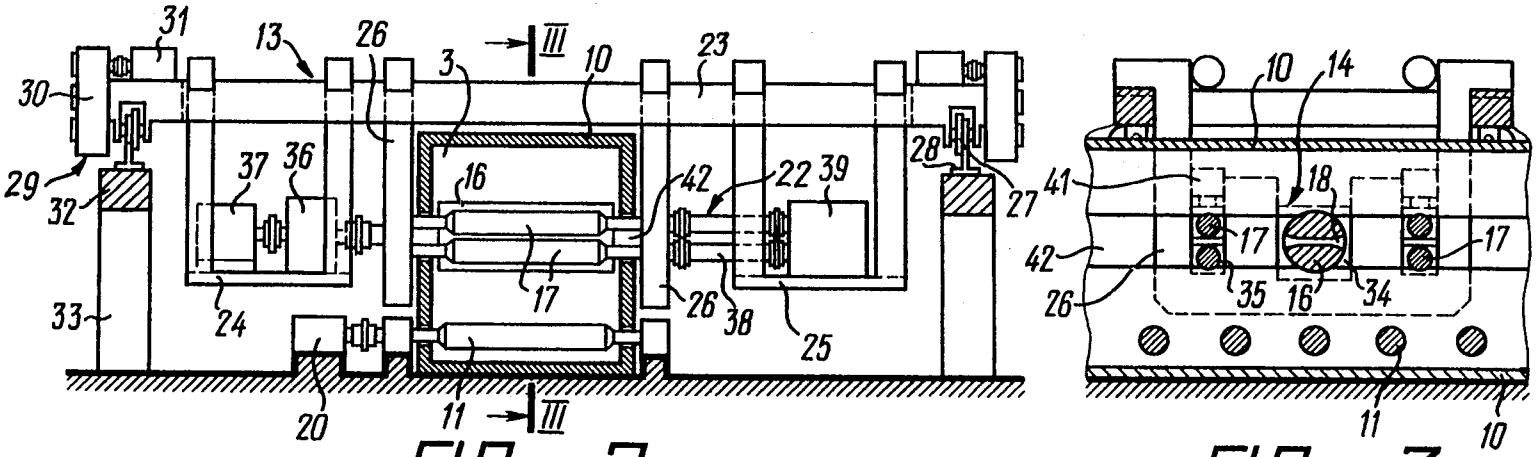
FIG. 3
FIG. 2
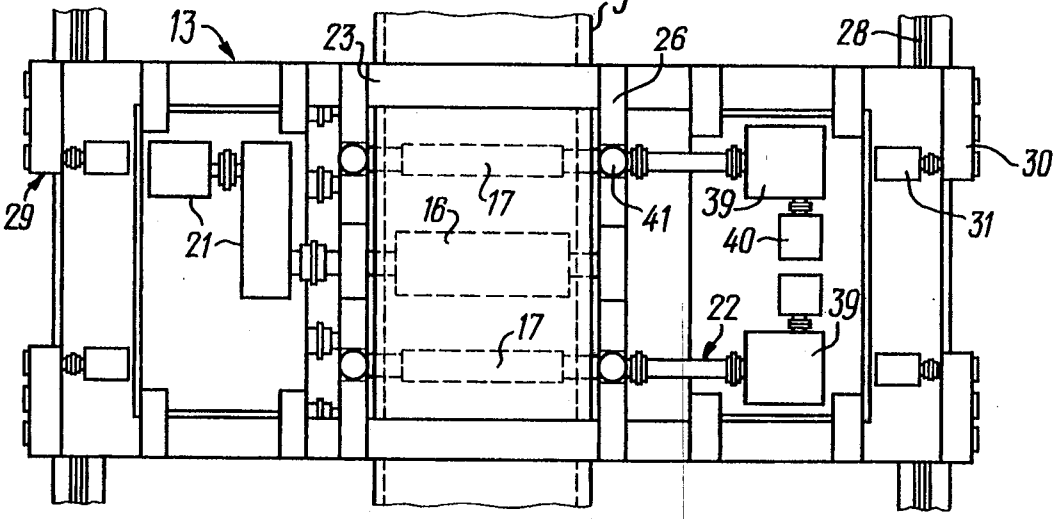
FIG. 4

METHOD AND APPARATUS FOR CONTINUOUS PRODUCTION HOT-ROLLED STRIPS

FIELD OF THE INVENTION

The invention relates to the motel rolling sad, in particular, it deals with a method end apparatus for continuous production of hot-rolled strips.

DESCRIPTION OF THE ART

It is known to produce hot-rolled strips by a method involving continuously costing a thin slob on a continuous casting machine, cutting the slab into measured lengths, heating the cut lengths of the slab in a through soaking-pit furnace, rolling the slab lengths into strips on a multiple-stand rolling mill, cooling the strips in a cooler, and winding on an end coiler. This method cells for a very long through soaking-pit furnace which is to accommodate in line at least three cut lengths of the slab. Moreover, the apparatus should be provided with a large number of rolling stands (at least four steads). This results in an increase in the investments for carrying out the method, and the weight of a hot-rolled strip coil used as feedstock for cold rolling is limited.

It is known to produce hot-rolled strips by a method involving continuously costing a thin slab on a continuous casting machine, hosting the lending portion of the continuous slab, which is of predetermined length end weight, in a through soaking-pit furnace, winding individual portions of the slab one by one into coils on a pair of coilers stationary installed in furnaces mounted one above the other in a vertical plane, carrying out the reversible rolling of each individual portion of the slab on a rolling mill, winding a strip being rolled during forward runs in the rolling mill on a third coiler provided downstream the rolling mill, cooling the strip in a cooler, and winding on an end coiler (U.S. Pat. No. 4,630,382). This method involves an intermittent rolling of cut lengths of a slab on a rolling mill. This results in the weight of a hot-rolled coil being limited to the maximum admissible weight of coils formed by coilers installed in the furnaces. Moreover, this method is characterized by a poorer quality of portions of a strip adjacent to the ends of the strip because of increased longitudinal thickness variations caused by rolling of these portions without tension.

A prior art method for continuous production of hot-rolled strips (U.S. Pat. No. 4,793,169) involves continuously casting a thin slab on a continuous casting machine, storing the slab in a storage means, feeding the slab from the storage zone at regular intervals in the form of consecutive slab lengths, heating in a through soaking pit means, rolling the individual lengths into a strip on a rolling mill in several runs with subsequent return of the rolled length into the storage zone, cooling the rolled strip in a coiler, cutting it into individual strips of a preset weight by sheers, and winding the individual strips one by one on end coilers. The slab lengths and the returned strip lengths are stored by looping.

An apparatus for carrying out this method comprises a line including a continuous casting machine for casting a continuous thin slab, a slab storage means, a through soaking-pit means, a rolling mill, a strip cooler, shears, and end coilers for winding the finished strip. The storage comprising a vertical looping means.

However, as the steps of storing slab lengths and rolled strip lengths and their heating are carried out at time intervals, the slab of strip is intensively cooled during storage in a looping means, and their subsequent heating to a preset temperature before rolling results in an increase in power requirements. At the same time, it is very difficult to carry out looping and heating combined in a through soaking pit means. In addition, as a very short time is given for preheating a length of the strip being rolled between two consecutive runs, the intensity of heating, hence power output of a soaking pit means should be increased which also results in an increase in power requirements.

Another disadvantage of the above-described method and apparatus resides in the small length of the slab or rolled strip stored during looping. This limits the rolled strip length before the final run, hence the continuously rolled lengths of the slab sad finished strip is also limited. This does not allow the major part lengthwise of such lengths to be rolled with the most favorable constant speed in several runs during rolling with the return of the rolled length. The tachographic record of the rolling features peaks (rolling with an acceleration from zero speed to the maximum with subsequent braking to zero). This means that each whole slab or strip length is rolled at a varying speed. If the hot rolling is carried out with a varying speed, temperature lengthwise of the strip also varies. Varying speed and temperature conditions lengthwise of the strip result in non-uniformity of the coiling force and moment which impair quality of the finished strip because of a greater thickness variation and a scatter of mechanical properties.

Intensive acceleration and braking of the strip during the entire rolling period result in high dynamic loads being applied to the rolling mill equipment.

SUMMARY OF THE INVENTION

The invention is based on providing a method and apparatus for continuous production of hot-rolled strips in which an increase in a portion of a strip rolled under constant speed and temperature conditions allows the quality of the rolled strip to be improved with lower power requirements for heating the slab and rolled strip portions, while reducing the time during which high dynamic loads are applied to the rolling mill.

This problem is solved by a method for continuous production of hot-rolled strips, comprising continuously casting metal into a thin slab, storing the slab, feeding it from the storage zone at intervals in the form of consecutive portions, heating, rolling into a strip in several runs with return of the portion being rolled to the storage zone, cooling, cutting, and coiling. According to the invention, the method comprises storing the slab and the returned strip portion simultaneously with heating, and storing them by their combined winding into a single intermediate coil, the intermediate coil being caused to move along the storage zone during the winding end dispensing portions of the slab and rolled strip.

Individual portions of the strip are preferably rolled by reversible rolling.

According to the invention, the intermediate coil is caused to move during rolling in a direction opposite to the direction of process flow of metal, the intermediate coil being uncoiled and moved in the direction of the process flow of metal during the dispensing of portions of the slab and strip.

It is preferred that the speed of the intermediate coil during winding be twice as low as the difference between the speed at which the strip leaves the rolling zone and the costing speed, the circumferential velocity of the coil being twice as low as the total of the speed at which the strip leaves the rolling zone and the costing speed, and it is also preferred theft the speed of the intermediate coil during the uncoiling be twice as low as the total of the casting speed and of the speed at which the strip is fed to the rolling zone, the circumferential velocity of uncoiling being twice as low as the difference between the speed at which the strip is fed to the rolling zone and the casting speed.

The above problem is also solved by in an apparatus for carrying out the method for continuous production of hot-rolled strips, comprising a line including a continuous metal casting machine for casting metal into a thin slab, a slab storage means, a through soaking-pit means for heating the slab, a rolling mill for rolling the slab into a strip in the form of individual portions with return of a portion being rolled into the storage means, a strip cooler, a cutting means, and a means for cooling the strip. According to the invention, the through soaking-pit mesas comprises a roller-hearth furnace, the storage means comprises at least one carriage provided outside the roller-hearth furnace for movement therealong, and a means for forming an intermediate coil from the slab and from the returned portion of the strip. The means for forming is being installed on the carriage and has, inside the furnace and over its rollers, a driven roll with a diametrical slot and two pairs of drawing rollers provided along, and on either side of the roll, longitudinally extending apertures being made in the side walls of the furnace which receive the ends of shafts of the driven roll and drawing rollers. The rolling mill of the apparatus is a reversing rolling mill.

Therefore, the storage of portions of the slab and strip, which is carried out according to the invention simultaneously with heating, by their combined winding in the through furnace into an intermediate coil allows heat losses from the slab leaving the continuous casting machine to be avoided. As a result energy consumption for heating portions of the slab and strip being rolled to a preset temperature is reduced. In addition, during return into the storage and heating zone of a slightly cooled portion of the strip being rolled from the rolling zone, its combined winding layer-by-layer together with a portion of a hotter and thicker slab, the feed is heated by the slab through heat transfer in a more effective way compared with non-contact heating methods. This also lowers energy consumption for heating portions of the strip being rolled.

Storing portions of the slab and of the strip being rolled by their combined winding into one or several intermediate coils allows the storage means capacity to be substantially increased in comparison with a looping means because the storage capacity is not limited to the depth of a looping pit. The space of the heating zone is used for storage, i.e., the storage and heating zones are combined. A substantial increase in the capacity of the storage means according to the invention allows the length of a slab portion continuously rolled on the rolling mill to be substantially increased. This enables the major part of length of this portion to be rolled in each run at a constant speed with relatively short portions of acceleration and braking at the beginning and end of the run. In rolling at a constant speed and a constant temperature, hence force and moment of the rolling are ensured lengthwise of the strip. Thickness variation and scatter of mechanical properties are thus minimized which improves quality of the strip.

The reduction of the fraction of portions of the strip rolled with acceleration and braking means a shorter time during which the rolling mill is subjected to high dynamic loads.

Storing portions of the slab and strip being rolled by carrying out their combined winding into an intermediate coil allows a continuous transfer of the continuously cast slab from the casting machine to the rolling mill without cutting into length. As a result, compared to an intermittent rolling of individual slabs, the number of end portions of a strip of a poorer quality rolled without tension is reduced. The number of engagements of the leading ends of the strips being rolled including engagements at a high speed during which the rolling mill equipment is subjected to unfavorable impact loads is substantially reduced. Owing to a continuous batched transfer of the slab from the casting machine to the rolling mill by means of the combined winding with a comparatively low weight of the intermediate coil, coils of finished hot-rolled strip can be produced which will have practically any desired weight which is very important for cold rolling.

Moving the intermediate coil along the storage zone during its winding and unwinding allows the continuous linear movement of the slab at a low casting speed at the entrance to the storage zone to be transformed into reciprocations (reversible movement) of the strip being rolled at a higher speed at the outlet of this zone so as to ensure a continuous combining of the steps of continuous casting of a thin slab with multiple-run reversible rolling of the strip in the form of individual consecutive portions with return of rolled portions.

The use of the reversible rolling of a continuous strip in individual portions allows production capabilities of the rolling mill, e.g., the range of strip stock to be enlarged.

Moving the intermediate coil during winding in the direction opposite to the process flow direction allows the return of a portion of the strip from the rolling zone or reversible pass thereof through the rolling mill to be timed with the storage of this returned portion.

Uncoiling and moving the intermediate coil in the process flow direction allow the delivery of portions of the slab and strip from the storage zone and rolling in the forward direction, in the rolling mill to be timed.

The above-mentioned ratios of the speeds winding or unwinding of the intermediate coil and of the strip movement at the boundary between the storage and rolling zones allows slab casting, storage and slab and rolled strip portions delivery and slab rolling into strip in the form of individual portions in several runs to be matched.

The apparatus for carrying out the method for continuous production of hot-rolled strips according to the invention is more compact and less energy consuming in comparison with prior art equipment and requires reduced investments for construction.

BRIEF DESCRIPTION OF THE DRAWINGS

The invention will now be described in detail with reference to specific embodiments illustrated in the accompanying drawings, in which:

FIG. 2 shows a front view of a carriage with a means for forming an intermediate coil;

FIG. 3 is a sectional view taken along line III—III in FIG. 2;

FIG. 4 is a plan view of the carriage shown in FIG. 2;

PREFERRED EMBODIMENT OF THE INVENTION

Figure 1:
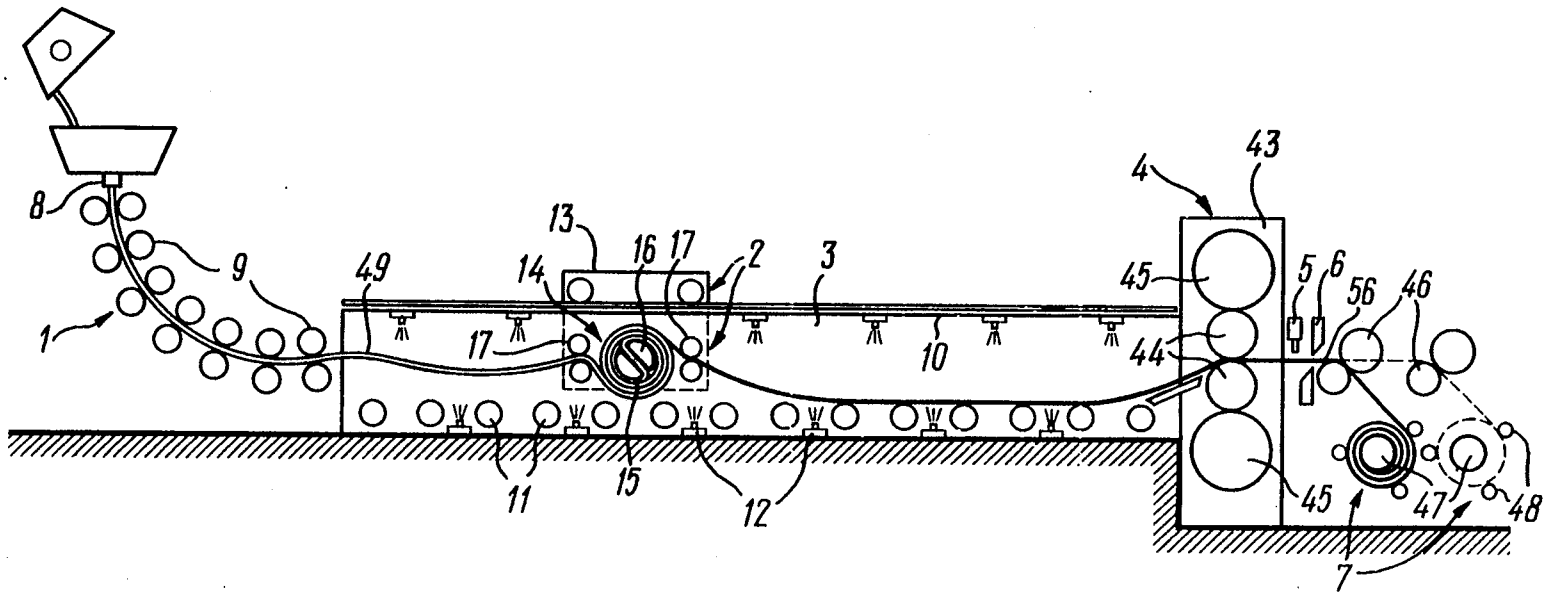
FIG. 1 schematically shows a general view of an apparatus for continuous production of hot-rolled strips according to the invention.

A method for continuous production of hot-rolled strips according to the invention comprises the following steps. Metal is cast into a thin slab which is stored and is fed at regular intervals from the storage zone in the form of consecutive portions, heated, rolled into a strip by individual portions in several runs with return of a portion being rolled into the storage zone, cooled, cut, and coiled. The storage is carried out by combined coiling of the slab and the returned portion of the rolled strip into one or several in intermediate coils depending on a production method simultaneously with heating and moving through the storage and heating zone. The intermediate coils are caused to move during winding in a direction opposite to the process flow of metal (i.e. opposite to the slab movement during its casting). When the slab portions and portions of an intermediate rolled strip are delivered, the coil (coils) is unwound end moved in the direction of the process flow of metal.

The slab may be rolled into strips depending on the production method either in one direction coinciding with the direction of process flow of metal or in two directions, i.e., by reversible rolling. It should be noted that, depending on the method of slab rolling, speeds of movement of the intermediate coil (coils) and circumferential velocities of winding of the slab and strip being rolled into the intermediate coil and uncoiling circumferential velocities are set up.

The method for continuous production of hot-rolled strips according to the invention is carried out in an apparatus which will be described in detail as applied to the reversible strip rolling which is more complicated in comparison with rolling in one direction, with a storage of slab and returned portions of a strip being rolled in a single intermediate coil.

An apparatus for producing hot-rolled strips comprises a line in a metal flow direction including a continuous metal casting machine 1 (FIG. 1) for casting a thin slab which if of a conventional type, a slab storage means 2 which is capable of delivering the slab by portions from a storage zone, a through slab soaking-pit means in the form of a roller-hearth furnace 3, a reversing rolling mill 4 of a conventional type which rolls a thin slab into a strip by individual portions in several runs, e.g., in three runs, with return of a rolled portion into storage means 2, a strip cooler 5, a means 6 for strip cutting, and a means 7 for coiling the rolled strip.

Continuous metal casting machine 1 is of a conventional type and has a mold 8 in which molten metal is solidified into a thin slab and a plurality of pairs of driven rollers 9 which pull the thin slab from mold 8.

Roller-hearth furnace 3 has one end wall thereof adjacent to the outlet part of metal casting machine 1, and the other end wall thereof is adjacent to reversible rolling mill 4. The furnace 3 has a casing 10 of a length which is chosen taking into account the maximum length of a continously rolled portion of the strip before the last run through rolling mill 4. A plurality of driven rollers 11 extend perpendicularly with respect to the direction of the slab movement and form a roller hearth for slab movement. Heating elements are in the form of gas burners 12.

Figure 5:
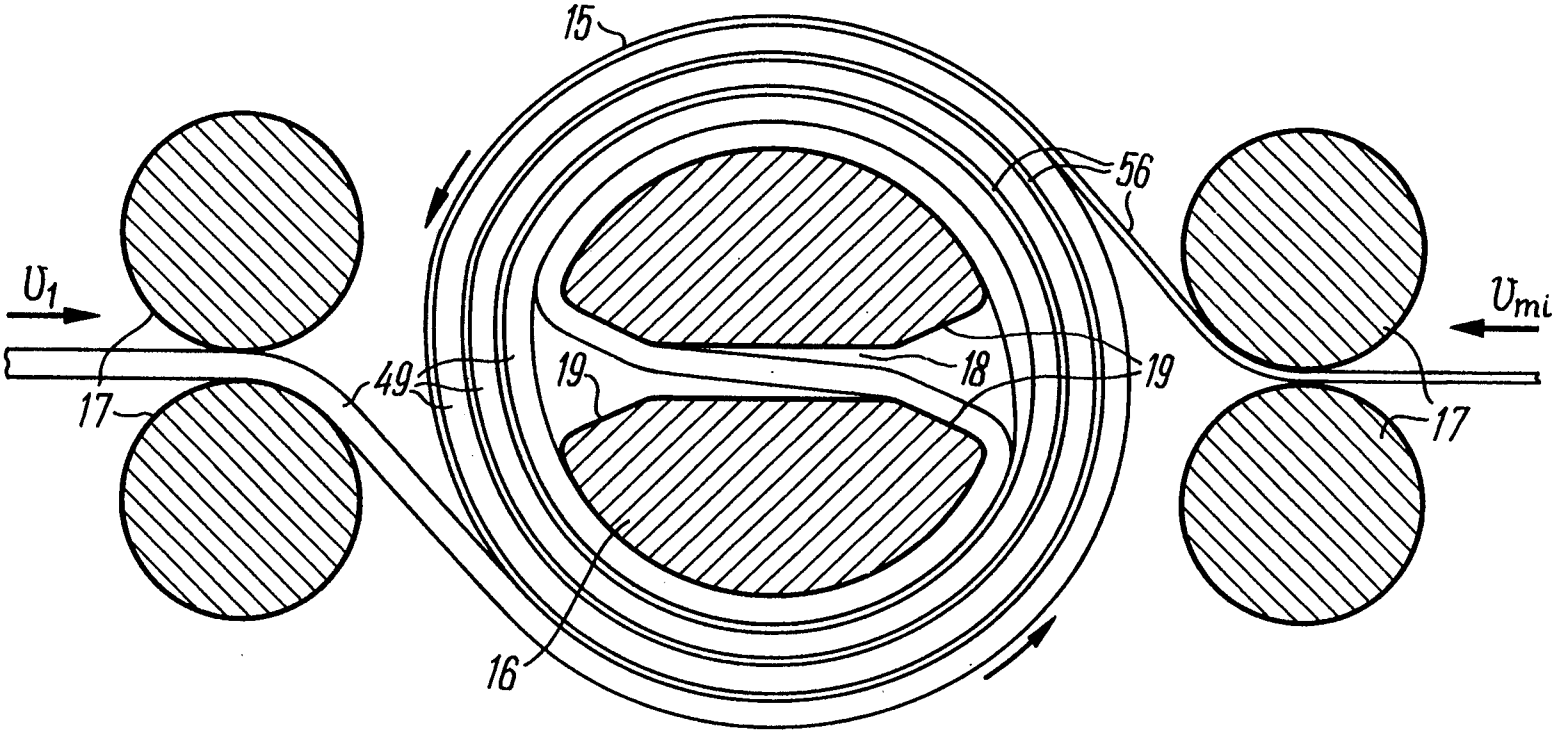
FIG. 5 shows a roll and pairs of drawing rollers with an intermediate coil thereon in a cross-sectional view.

Storage means 2 comprises a carriage 13 provided outside roller-hearth furnace 3 for movement along the furnace and a means 14 for forming an intermediate coil 15 from the slab and returned portion of a strip portion being rolled. Coil 15 is mounted on carriage 13 and has a driven roll 16 and two pairs of drawing rollers 17 (FIG. 2 through 4) which are positioned in soaking-pit furnace 3 over its rollers 11. Driven roll 16 has a diametrical slot 18 extending lengthwise thereof (FIG. 5) which has enlarged inlet and outlet portions 19 to allow the slab or portions of the strip to move smoothly around the parts of roll 16 when wound on intermediate roll 15. Two pairs of drawing rollers 17 are mounted to extend along roll 16 end are aligned on either side upstream end downstream of the roll.

All units of carriage 13 (FIGS. 2 through 4), drive 20 of rollers 11 of furnace 3, a drive 21 of roll 16, end drives 22 of drawing rollers 17 are provided outside furnace 3.

Carriage 13 has a carrying frame 23 end a pair of suspended plates 24 and 25 positioned on either side of furnace 3. Suspended plates 24, 25 and a pair of beds 26 are attached to carrying frame 23 which has wheels 27 mounted on rails 28 of furnace 3. Carrying frame 23 also supports a means 29 for moving carriage 13 along furnace 3. Means 29 has reduction gears 30 end motors 31 for each wheel 27. Rails 28 are installed on beams 32 supported by columns 33 on either side of furnace 3 along the whole length of the furnace.

Pads 34 of roll 16 and pads 35 of drawing rollers 17 are received in openings of two beds 26 of means 14 for forming the intermediate coil. Drive 21 of roll 16 has a reduction gear 36 end a motor 37 and is mounted on a suspended plate 24 on one side of funace 3. Drives 22 of both pairs of drawing rollers 17 comprising spindles 38, gear stands, end reduction gears mounted in integral casings 39, and motors 40 are mounted on suspended plate 25 on the other side of furnace 3. Screw-down means 41 of drawing rollers 17 are mounted in the top part of lateral openings of beds 26. To ensure unhampered movement of carriage 13 along furnace 3, the side walls of its casing 10 have longitudinally extending apertures 42 (FIGS. 2, 3) for receiving the ends of shafts of driven roll 16 and drawing rollers 17. These apertures 42 may be covered by heat insulating members which are retractable from the apertures during movement of the ends of the shafts of roll 16 and drawing rollers 17 (FIG. 1).

Reversing rolling mill 4 has one or several workstands 43, the number of which depends on the chosen range of fin products and adopted production method. Each workstand 43 has, e.g., four rolls: two workrolls 44 and two backup rolls 45, a drive for rotating the rolls, and a screwdown means for varying the nip between rolls during rolling (not shown in the drawing).

Strip cooler 5 has manifolds for regular controlled supply of a liquid coolant to the strip (not shown).

Cutting means 6 has shears of a conventional type for cutting the strip during its movement.

Means 7 for coiling the rolled strip comprises at least two conventional coilers having feed rollers 46, a driven roll 47, and rollers 48 for pressing the strip being coiled.

The apparatus according to the invention functions in the following manner.

Figure 6:
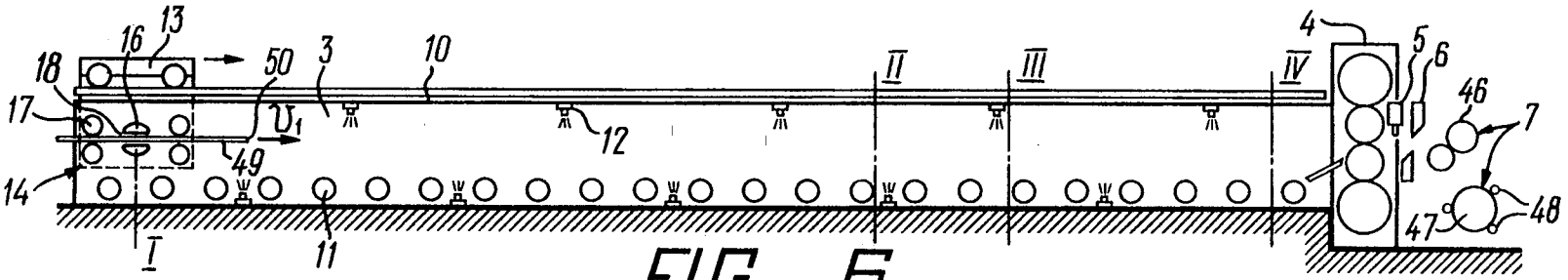
FIGS. 6 through 13 schematically show the steps of feeding, storage sad rolling of slab into a strip.

Molten metal fed to mold 8 is solidified and withdrawn in the form of a thin slab 49 by means of driven rollers 9, the slab thickness being a maximum 40 mm so that it can be wound on intermediate coil 15. After leaving casting machine 1, thin slab 49 is continuously fed at a casting speed $V_1$ (FIG. 6) into a storage and heating zone, i.e., to roller-hearth furnace 5 and means 14 for forming an intermediate coil. Carriage 13 is at starting position I at the entrance to furnace 3. The distance between the input cross-section of the furnace and initial position I of carriage 13 is $L_I=12$ m, between positions II and III is $L_{II-III}=5$ m, between positions II and IV is $L_{III-IV}=9.5$ m, between position IV and output cross-section of the furnace is $L_{IV}=2$ m.

Figure 7:
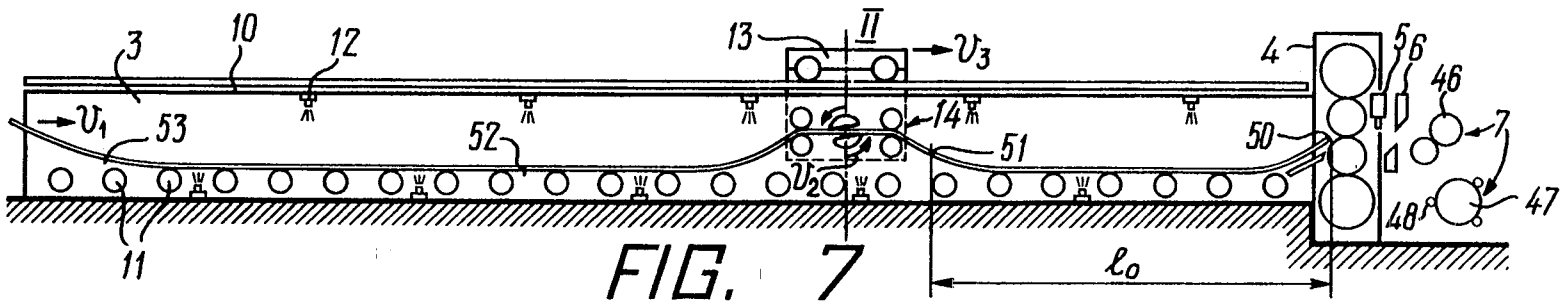
Figure 8:
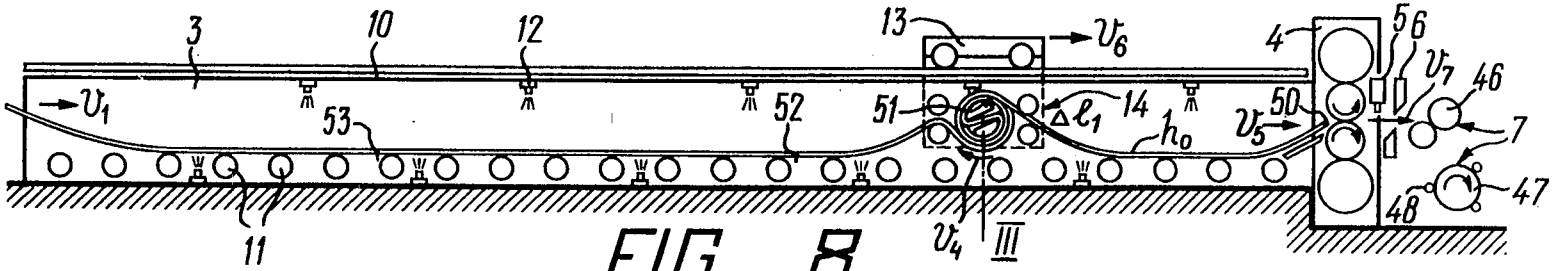

Distances $L_I$ and $L_{IV}$ are chosen from structural considerations. The distances $L_{I-II}$, $L_{II-III}$ and $L_{III-IV}$ and, respectively, positions I, II, III, and IV are determined by taking into consideration the time and speed of movement of carriage 13 in the runs. The length of the furnace $L_F=L_I+L_{I-II}+L_{II-III}+L_{III-IV}+L_{IV}$, and may be 46 m in a preferred embodiment. The speed $V_{10}$ of returning the carriage from position IV to position II, $V_{10}=(L_{III-IV}+L_{II-I})/\tau_1$ and in a preferred embodiment $V_{10}=(5+9.5)/5=2.9$ m/a. An excess of slab wound in a coil before the first run of a current section of slab is $\Delta l_l$ and is preferably 10 m. An excess of slab and feed wound in a coil by the end of the second run is $l_2$ and is preferably 65 m. The leading end 50 of slab 49 is fed to the nip between upstream drawing rollers 17, passes through the diametrical slot 18 of drum 16 and through the nip between downstream drawing rollers 17. Leading end 50 of slab 49 having passed through means 14 for forming an intermediate coil continues to move through furnace 3 toward rolling mill 4 at the casting speed $V_1$, and carriage 13 moves in the same direction at a lower speed. At the moment leading end 50 of slab 49 approaches the entrance to rolling mill 4 carriage 13 moves to position II of the beginning of winding of the slab on intermediate coil 15. In the example below, the average value of this initial speed of the carriage 13 movement from position I to position II is 0.064 m/s. Beginning with this moment, roll 16 and both pairs of rollers 17 start rotating to wind slab 49 into coil 15 with a circumferential velocity of winding $V_2=V_1/2$ (FIG. 7). Carriage 13 continues to move and starts moving coil 15, which is being formed, in the direction of process flow of metal at a speed $V_3=V_1/2$, and storage of a portion of the slab in coil 15 is started. Leading end 50 of slab 49 remains stationary at the entrance to rolling mill, and slab 49 is continuously fed to the storage and heating zone at the speed $V_1$. By the moment carriage 13 approaches position III of the beginning of slab uncoiling, an excess of slab $\Delta l_l$ is accumulated in coil 15. Beginning with this moment roll 16 and both pairs of drawing rollers 17 start rotating in the opposite direction to unwind slab 49 from coil 15 at a circumferential velocity of uncoiling $V_4=(V_5-V_1)/2$ (FIG. 8), wherein $V_5$ is the speed at which the slab is fed to the rolling zone for the first run. Carriage 13 continues to move and causes coil 15 being uncoiled to move in the same direction of process flow of metal but now at a speed $V_6=(V_1+V_5)/2$, and a first portion of slab of a length $l_o$ is delivered at the speed $V_5$ from the storage and heating zone and the first run of this portion through rolling mill 4 is started. Rollers 11 of furnace 3 which are located between the entrance to furnace 3 and carriage 13 rotate at the circumferential velocity $V_1$ and rollers 11 which are located between moving carriage 13 and rolling mill 4 rotate at the circumferential velocity $V_5$. During the first run of the first portion of slab 49 which has a thickness of $h_o$ and a length $l_o$ (the boundaries of this portion are shown at 50 and 51) the slab is rolled into a portion of a strip which has a thickness of $h_1$ and a length of $l_1=l_oh_o/h_1$ which is wound on the first end coiler of means 7 when its Leaves rolling mill 4. It should be noted that the major part $l_{ol}$ of this portion is fed to rolling mill 4 at the speed $V_5$ which is much higher than speed $V_1$, and it is rolled at the speed at which the strip leaves the rolling zone $V_7=V_5h_o/h_1$ until carriage 13 approaches position IV and the earlier stored excess of slab $\Delta l_1$ has been fully uncoiled.

Figure 9:
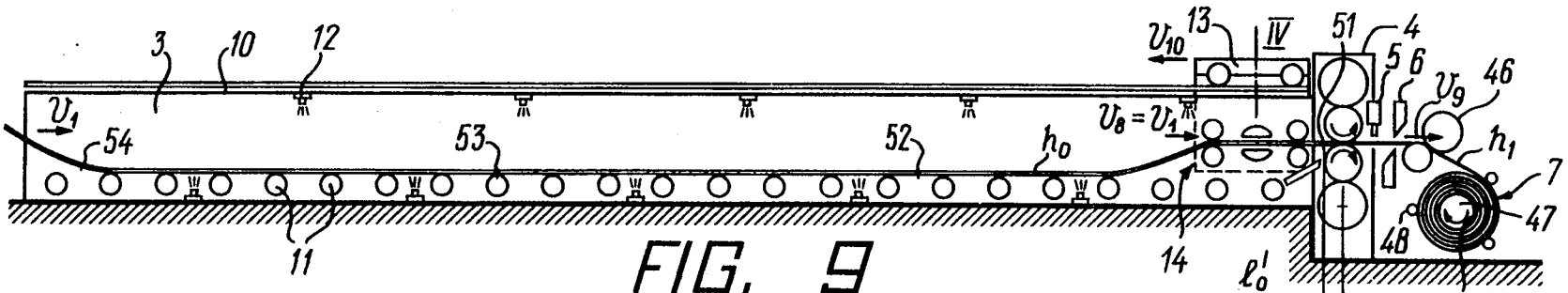
Figure 10:
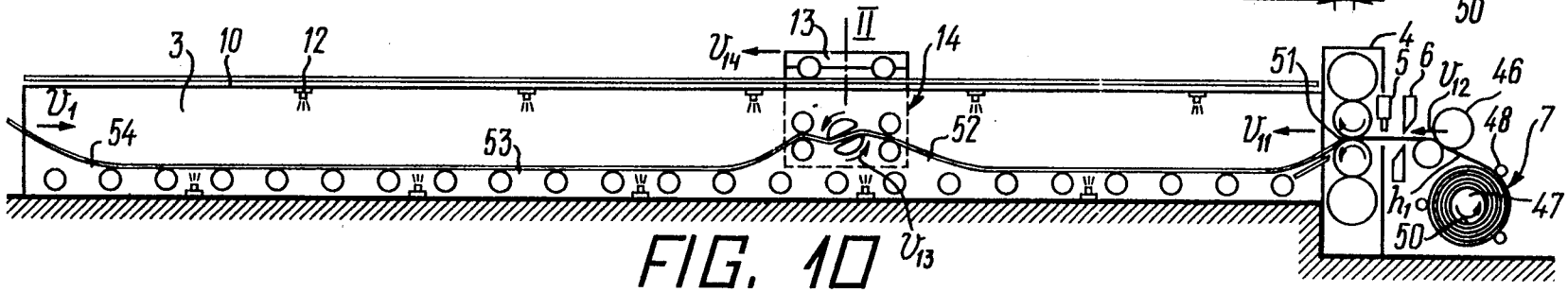

After carriage 13 has approached position IV and after uncoiling, the remaining part $l'_o=l_o-l_{01}$ of the portion of slab 49 of the length $l_o$ is fed to rolling mill 4 at a speed $V_8=V_1$ and is rolled at a speed the strip leaves the rolling zone $V_9=V_1h_o/h_1$ (FIG. 9). During rolling of this remaining part $l'_o$, carriage 13 with drawing rollers 17 spaced apart and roll 16 which remains in the position where its diametrical slot 18 extends horizontally is returned at a speed $V_{10}$ to position II. After the first run rolling mill 4 is reversed, the nip between rolls is reduced, sad portion 50–51 of the strip of thickness $h_1$ and length $l_1$ is rolled into a portion of the strip of thickness $h_2$ and length $l_2=l_0h_0/h_2$, at a speed $V_{11}=V_{12}h_1/h_2$ (FIG. 10) wherein speed $V_{12}$ is the speed at which the rolled strip portion is fed to the rolling zone from the end coiler of means 7 during the second run. During the second run the starting strip of thickness $h_1$ is fed to lolling mill 4 at the speed $V_{12}$, and the rolled strip of thickness $h_2$ is accommodated in the storage and heating zone as a result of its combined winding together with portions 51–52, 52–53, 53–54 of the slab which see within furnace 3 and which follow the first portion 50–51 and portion 54–55 of the slab partly entering furnace 3. The winding is started from position II simultaneously with the beginning of the second run, and only the slab is coiled initially. The combined winding of both the slab and strip begins only after the end of portion 50–51 of the feed nearest to carriage 13 catches up with the carriage. The winding is carried out at a circumferential velocity $V_{13}=(V_{11}+V_1)/2$ with simultaneous movement of coil 15 being wound by means of carriage 13 at a speed $V_{14}=(V_{11}-V_1)/2$ in a direction opposite to the direction of process flow of metal. Furnace rollers 11 located between rolling mill 4 and carriage 13 rotate at a circumferential velocity $V_{11}$ in the opposite direction, and rollers 11 located between carriage 13 and entrance to furnace 3 rotate at a velocity $V_1$ in the direction of process flow of metal. At the moment the second run is over, the winding is suspended, and carriage 13 is stopped. The carriage can be stopped at any rate at position I at the entrance to the furnace. An excess $\Delta l_2$ of the slab and strip is thus stored in coil 15.

Figure 11:
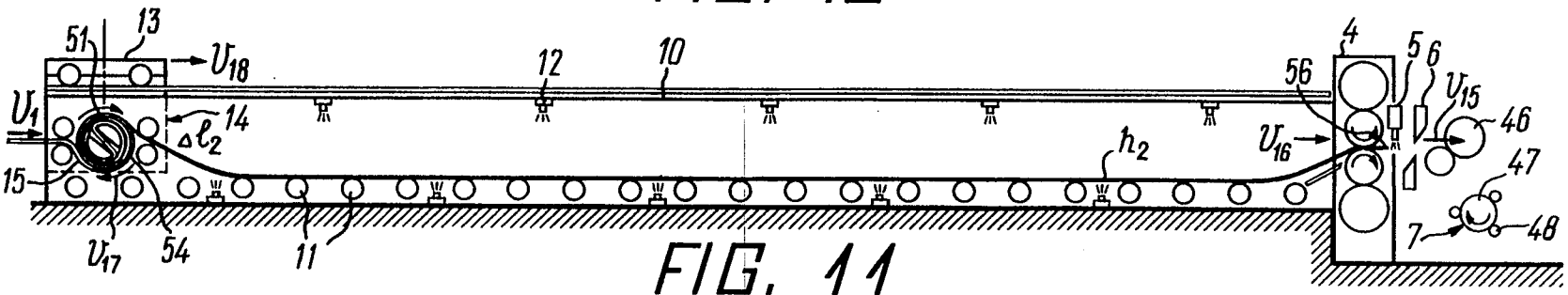

Rolling mill 4 is reversed, the nip between rolls is reduced, and rolling of portion 50–51 of thickness $h_2$ and length $l_2$ and a portion of thickness $h_3$ and length $l_3=l_oh_o/h_3$ is carried out at a speed $V_{15}=V_{16}h_2/h_3$ wherein $V_{16}$ is the speed at which the strip is fed into the rolling zone during the third run (FIG. 11). The strip is fed to rolling mill 4 at the speed $V_{16}$ by uncoiling the excess $\Delta l_2$ stored in coil 15 at a speed $V_{17}=(V_{16}-V_1)/2$ with simultaneous movement of unwound coil 15 at a speed $V_{18}=(V_{16}+V_1)/2$ in the direction of process flow of metal. Furnace rollers 11 located between the entrance to furnace 3 and carriage 13 rotate at a circumferential velocity $V_1$ and rollers 11 between carriage 13 and rolling mill 4 rotate at the speed $V_{16}$.

Figure 12:
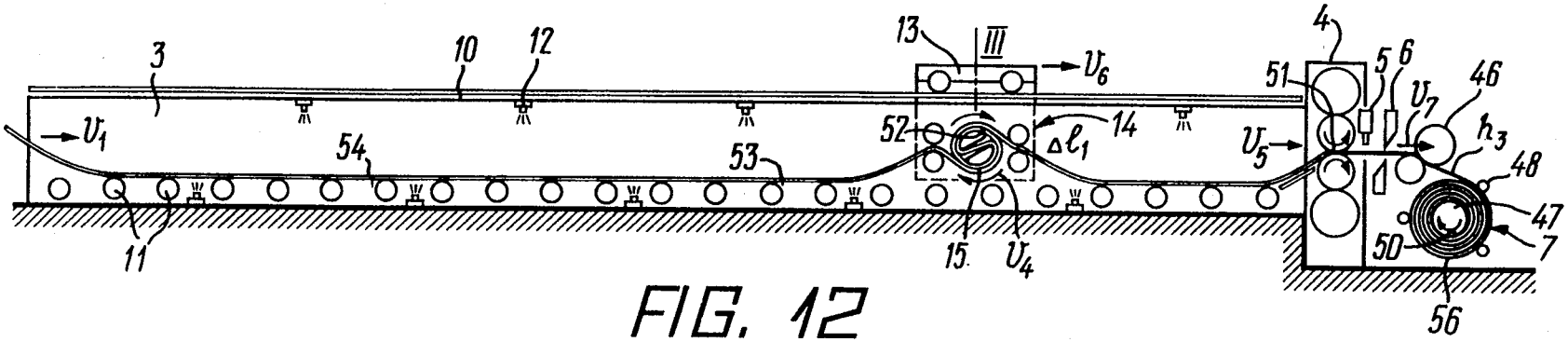
Figure 13:
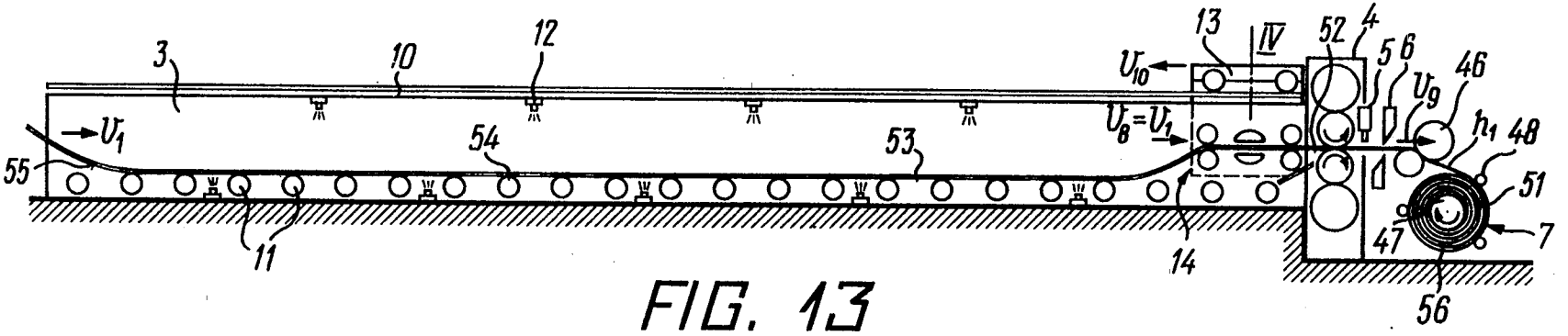

During the final third run, a strip 56 leaving rolling mill 4 is cooled with water from means 5 and wound on the end coiler of means 7. At the moment the final third run of first portion 50–51 of the slab is over carriage 13 moves to position III of the beginning of unwinding of the slab, and coil 15 is available on means 14 of carriage 13 with the stored excess $\Delta l_1$ of the slab for delivery for the first run of second portion 51–52 of the slab. The first run of second portion 51–52 of the slab (FIGS. 12, 13) and the remaining runs are carried out similarly to the runs carried out with first portion 50–51. The remaining portions of slab 49 are rolled in the same manner. As the coil of full weight of finished strip 56 is wound on one of the end coilers of means 7, strip 36 is cut by shears 6, and the next strip is wound on the other end coiler of means 7. It should be noted that as the finished strip moves continuously through the whole plant, coils of any size can be formed which is very important for subsequent cold rolling. The embodiment of rolling in three runs has been described, but it is apparent that rolling with any odd or event numbers of runs is possible. If necessary, the rolls can be spaced apart during an even-numbered run, and the strip can be passed in the opposite direction without reduction.

To carry out the method according to the invention, it is necessary that continuous casting and reversible rolling of one and the same portion of the slab be identical, and this conditions is as follows:

$$l_D/V_1 = \sum_{i=1}^{K} (l_{i-1}/V_{ni}) \text{ or } l_D/V_1 = \sum_{i=1}^{K} (l_i/V_{mi})$$

wherein i is the number of run through the rolling mill;

K is the number of runs;

$l_i$ is the length of a strip portion after an ith run;

$V_{ni}$ and $V_{mi}$ are the average speeds of the rolled strip at the inlet and outlet of the rolling mill during an ith run.

Therefore, if this condition is met and the above-mentioned formula for determining velocities are used, anyone skilled in the art can, given parameters of the slab and finished hot-rolled strip, calculate concrete values of all process and structural parameters for the production of hot-rolled strips.

The apparatus according to the invention is capable of storing slab and strip by forming several intermediate coils. In such case the apparatus should have an appropriate number of carriages 13, each having means 14 for forming intermediate coils. The winding and unwinding speeds and speed of movement of the intermediate coils can be determined in this case by using the above formulae and taking into account the production method.

The invention allows cooling of portions of a continuously cast slab after it leaves the continuous casting machine to be avoided and ensures a more efficient heating of portions of a strip between even-numbered and odd-numbered runs through heat transfer from the slab portions during their combined coiling. This facility results in a substantial reduction of power requirements.

An increase in capacity of a storage means and a respective increase in length of continuously rolled portions of the slab and strip result in a decrease in the part thereof which is rolled at a constant speed, hence, under varying temperature and speed conditions and under varying forces and power input. The yield of finished products of enhanced quality is respectively increased. In addition, owing to a decrease in the fraction of the strip rolled with acceleration or deceleration, the time during which the rolling mill is exposed to dynamic loads is proportionally reduced. The method of the claimed invention may be further described by a discussion and recitation of the characteristic values of the parameters involved in an illustrative example.

Thickness $h_0$ of a continuously cast slab can be in the range of from 15 mm to 40 mm and, in the following example, $h_0=20$ mm.

The speed $V_1$ of casting thin slab can be within the interval from 3.6 m/min to 7 m/min (for example, 3.6 m/min in U.S. Pat. No. 4,793,169; and 6 m/min to 7 m/min in FRG Patent WO 89/08512). In the following example, $V_1=6$ m/min=0.01 m/a.

The thickness $h_K$ of a finished hot-rolled strip can be in the range of 2 mm to 12 mm and in the given example, $h_K=2.5$ mm.

Knowing the values of parameters, $h_0$, $h_K$, and $V_l$, and using the above formulae and equations, a person skilled in the art can determine the specific values of all the parameters of the method.

Give the thickness of the slab $h_0$ and the thickness of the finished strip $h_K$, using methods from the theory of rolling, and taking into account the steel grade, strip thickness, and slab temperature, one can determine the number of runs K and the conditions of reduction. That is, one can determine the thickness of the strip after the corresponding runs, $h_1$, $h_2$, ..., $h_K$. In the given example, the slab thickness $h_0=20$ mm, the width $b_0=1000$ mm, the material is carbon steel, the slab temperature t=1150 degrees Celsius, the number of runs, K=3, and the strip thickness in the runs K=3, and the strip thicknesses in the runs $h_1=10$ mm, $h_2=5$ mm, and $h_3=2.5$ mm.

All the parameters, tabulated, are as follows:

TABLE 1

| i: | $h_{i-1}$: | $h_i$: | $l_{i-1}$: | $l_i$: | $\tau_i$: | $V_{ni}$: | $V_{mi}$: | $V_{ci}$: | $V_{ui}$: | $V_{cari}$ |
|---|---|---|---|---|---|---|---|---|---|---|
| 1 | 20 | 10 | 15 | 30 | 50 | 0.3 | 0.6 | — | 0.111 | 0.211 |
| 2 | 10 | 5 | 30 | 60 | 50 | 0.6 | 1.2 | 0.65 | — | 0.55 |
| 3 | 5 | 2.5 | 60 | 120 | 50 | 1.2 | 2.4 | — | 0.55 | 0.65 |

wherein;

i=number of a run in a rolling mill $h_{i-1}$=thickness of a slab or rolled strip before the i-th run, (mm)

$h_i$=thickness of a strip after the i-th run (mm)

$l_{i-1}$=section length of a slab or rolled strip before the i-th run, (m)

$l_i$=section length of a strip after the i-th run (m)

$\tau_i$=time of the i-th run of the section of a slab or rolled strip in the rolling mill (c)

$V_{ni}$=average speed of the slab or strip at the input to the rolling mill in the i-th run (m/a)

$V_{mi}$=average speed of the strip at the output from the rolling mill in the i-th run (m/a)

$V_{ci}$=average circumferential speed of the slab and rolled strip winding onto an intermediate coil during the i-th run (m/a)

$V_{ui}$=average circumferential speed of the slab and rolled strip unwinding from an intermediate coil during the i-th run (m/a)

$V_{cari}$=average speed of movement of the carriage 13 with the intermediate coil during its winding and unwinding in the i-th run (m/a)

In the present example, length $l_0$ of one section of the slab is $l_0$=15 m. The lengths of the strip sections after corresponding runs are determined as follows:

The length $l_1$ may be determined from the formula at line 1, page 14: $l_1=l_0h_0/h_1=(15\times20)/10=30$ m.

The length $l_2$ may be determined from the formula at line 21, page 14: $l_2=l_0h_0/h_2=(15\times20)/5=60$ m.

The length $l_3$ may be determined from the formula at line 21, page 15: $l_3=l_0h_0/h_3=(15\times20)/2.5=120$ m.

The time of casting $\tau$ of a section of a slab of length $l_0$ may be determined from the equation on page 16:

$$\tau=l_0/V_1=15/0.1=150\ a.$$

This time equals the cycle of rolling of this section or the sum of time of runs $\tau_1$, $\tau_2$, and $\tau_3$. Assuming that the time of all runs is the same, then $\tau_i=\tau_1=\tau_2=\tau_3=\tau/K=150/3=5$ a.

It is to be noted that time $\tau_1$, of the first run given in table 1 is the sum:

$$\tau_1=\tau_{11}+\tau_1,$$

wherein $\tau_{11}=l_{01}/V_{n11}=l_{11}/V_{m11}=14.5/0.322=29/0.644=45$ s is the time of rolling portion $l_{01}=14.5$ m from section $l_0=15$ m of the slab to portion $l_{11}=29$ m from section $l_1=30$ m of the strip at a speed of entering the mill $V_{n11}=0.322$ m/s, and of leaving thereof $V_{m11}=0.644$ m/s;

$\tau'_1=l'_0/V_0=l'_1/V_9=0.5/0.1=1/0.2=5$ s is the time of rolling portion $l'_0=0.5$ m from section $l_0=15$ m of the slab to portion $l'_1=1$ m of section $l_1=30$ m of the strip at a speed of entering the mill $V_8=0.1$ m/s, and of leaving thereof $V_9=0.2$ m/s.

The values of the speed of the first run given in Table 1, $V_{n1}$ and $V_{m1}$, are the average values for the total time, $\tau_1$, of the first run $$V_{n1}=V_{n11}\,\tau_{11}/\tau_1+V_8\,\tau'_1/\tau_1$$

$$V_{m1}=V_{m11}\,\tau_{11}/\tau_1+V_9\,\tau'_1/\tau_1$$

The speeds of the runs are found from the following formulae:

$$V_{ni}=\frac{l_i-1}{\tau_i},\ V_{mi}=V_{ni}\frac{h_i-1}{h_i}$$

$$V_{ci}=(V_{mi}+V_1)/2,\ V_{ni}=(V_{ni}-V_1)/2$$

$V^c_{cari}=(V_{mi}-V_1)/2$ in the process winding, $V^u_{cari}=(V_{ni}+V_1)/2$ in the process unwinding.

The average numerical values of the speeds for the time of the run are determined from the following formulae:

$V_1=0.1$ m/s is the casting speed.

$V_2=V_1=(0.1)/2=0.05$ m/s is the circumferential speed of winding a slab onto an intermediate coil before the first run of the first section, $V_3=V_1=(0.1)/2=0.05$ m/s is the speed of movement of the carriage before the first run of the first section in the process of winding the slab onto an intermediate coil, $$V_4 = (V_5 - V_1)/2 \text{ or } V_{u1} = (V_{u11} - V_1)/2 = (0.322 - 0.1)/2 = 0.111 \text{ m/s}$$

is the circumferential speed of unwinding the slab from the intermediate coil in the first run.

$V_5=V_{n11}=l_{01}/\tau_{11}=14.5/45=0.322$ m/s is the speed of entering the mill in the first run of portion $$V_6 = (V_5 + V_1)/2 \text{ or } V^u_{car1} = (V_{n1} + V_1)/2 = (0.3 + 0.1)/2 = 0.2 \text{ m/s}$$

is the speed of the carriage with the coil movement in the first run during unwinding $V_7=V_{m1}=V_{n1}h_0/h_1=0.3\times20/10=0.6$ m/s is the speed at which the strip leaves the mill in the first run, $V_8=V_1=0.1$ m/s is the speed of entering the rolling mill of portion $l'_0$ of the slab in the first run, $$V_9 = V_1\frac{h_0}{h_1} = 0.1 \times (20/10) = 0.2 \text{ m/s}$$

is the speed of leaving the rolling mill of a portion of the slab section, set by the speed $V_1$ in the first run $V_{10}=2.9$ m/s is the speed of the carriage return from position IV into position II (calculations above), $$V_{11} = V_{m2} = V_{n2}\frac{h_1}{h_2} = 0.6(10/5) = 1.2 \text{ m/s}$$

is the speed at which the strip leaves the rolling mill in the second run, $$V_{12} = V_{n2} = \frac{l_i}{\tau_2} = 30/50 = 0.6 \text{ m/s}$$

is the speed at which the strip enters the rolling mill in the second run, $$V_{13} = (V_{11} + V_1)/2 \text{ or } V_{c2} = (V_{m2} + V_1)/2 = (1.2 + 0.1)/2 = 0.65 \text{ m/s}$$

is the circumferential speed of winding the slab and strip in an intermediate coil in the second run, $$V_{14} = (V_{11} - V_1)/2 \text{ or } V^c_{car2} = (V_{m2} - V_1)/2 = (1.2 - 0.1)/2 = 0.55 \text{ m/s}$$

is the speed of the carriage movement during the coil winding in the second run, $V_{15}=V_{m3}=V_{n3}h_2/h_3=1.2\ (5/2.5)=2.4$ m/s is the speed at which the strip leaves the rolling mill in the third run, $V_{16}=V_{n3}=l_2/\tau_3=1.2$ m/s is the speed at which the strip enters the rolling mill at the third run, $V_{17}=(V_{16}-V_1)/2$ or $V_{u3}+V_1)/2=(1.2-0.1)/2=0.55$ m/s is the circumferential speed of unwinding the coil in the third run, $V_{18}=(V_{16}+V_1)/2$ or $V^7_{car3}=V_{u3}+V_1)/2=(1.2+0.1)/1==0.65$ m/s is the speed of the carriage movement during the coil unwinding in the third run.

The working of steady-state values of the above-listed speeds are determined using the same formulae taking into consideration acceleration and deceleration of the strip in the rolling mill in reversal.

Industrial Applicability

The method and apparatus for continuous production of hot-rolled strips rosy be widely used at metal works for making sheet stock for various industries such as automotive industry, electrical engineering, etc.

We claim:

1. A method for continuous production of hot-rolled strips, comprising continuously casting metal into a thin slab, storing the slab, feeding the slab at regular intervals from a storage zone in the form of consecutive portions, heating, rolling into a strip in the form of consecutive postions in several runs with return of the rolled portion into the storage zone, cooling, cutting, and coiling, characterized by storing the slab and the returned portion of the strip by their combined coiling into at least one intermediate coil which is moved along the storage zone during coiling and uncoiling of portions of the slab and rolled strip therefrom.

2. A method of claim 1, characterized by reversible rolling individual portions of the strip.

3. A method of claims 1 and 2, characterized by the the intermediate coil is moved in a direction opposite to the process flow of metal during coiling, and by the fact that the intermediate coil is uncoiled and moved in the direction of the process flow of metal during delivery of portions of the slab and strip.

4. A method of claim 3, characterized by the fact that the speed of movement of the intermediate coil during the coiling is twice as low as the difference between the speed at which the strip leaves the rolling zone and the casting speed, the circumferential velocity of the coil being twice as low as the total of the speed at which the strip leaves the rolling zone and the casting speed, and by the fact that the speed of the intermediate coil during the uncoiling is twice as low the total of the casting speed and of the speed at which the strip is fed to the rolling zone, the circumferential velocity of uncoiling being twice as low as the difference between the speed at which the strip is fed to the rolling zone and the casting speed.

5. An apparatus for continuous production of hot-rolled strips, comprising a line including a continuous metal casting means for casting metal into a thin slab, a slab storage means, a through slab soaking-pit means, a rolling for rolling the slab into a strip in the form of individual protions in several runs with return of a portion being rolled to the storage means, a strip cooler means, a cutting means, and a means for coiling the rolled strip, characterized by the fact that the through soaking-pit means comprises a roller-hearth furnace, the storage means comprises at least one carriage provided outside the roller-hearth furnace for movement therealong, and a means for forming an intermediate coil of the slab and of the returned portion of the strip, said means being installed on the carriage and having a driven roll having a diametrical slot and a pair of drawing rollers along, and on either side of the roll positioned in the soaking-pit furnace over its rollers (11), the side walls of the furnace having longitudinally extending apertures receiving the ends of shafts of the driven roll and drawing rollers.

6. An apparatus of claim 5, characterized byt he fact that the rolling mill is reversible.

* * * * *

UNITED STATES PATENT AND TRADEMARK OFFICE

CERTIFICATE OF CORRECTION

PATENT NO. : 5,437,089
DATED : August 1, 1995
INVENTOR(S) : Salganik, et al.

It is certified that error appears in the above-identified patent and that said Letters Patent is hereby corrected as shown below:

Column 1,
Line 6: Change, "the motel rolling sad" to -- metal rolling and --.
Line 7: Change "end" to -- and --.
Line 10: Change "THE ART" to -- THE PRIOR ART --.
Line 12: Change "costing a thin slob" to -- casting a thin slab --.
Line 21: Change "steads" to -- stands --.
Line 26: Change "costing" to -- casting --.
Line 27: Change "hosting the lending" to -- heating the leading --.
Line 28: Change "end" to -- and --.
Line 38: Change "4,630,382" to -- 4,630,352 --.
Line 56: Change "coiler" to -- cooler --.
Line 65: Change the period after "strip" to a comma.
Line 66: Change "The" to lower case -- the --.

Column 2,
Line 1: change "of" to -- or --.
Line 10: Insert a comma after "means".
Line 16: Change "sad" to -- and --.
Line 27: Change "result" to -- results -- .
Line 28: Change "coiling" to -- rolling -- and change "impair" to -- impairs --.
Line 57: Change "end" to -- and --.

Column 3,
Line 2: Change "costing" to -- casting --.
Line 4: Change "costing" to -- casting --.
Line 5: Change "theft" to -- that --.
Line 12: Delete "in".
Line 27: Delete "being".

Column 5,
Line 11: Change "sad" to -- and --.
Line 24: Delete "in".
Line 31: Change "end" to -- and --.

Column 6,
Line 24: Change "end" to -- and --.
Line 33: Change "end" to -- and --.
Line 40: Change "end" to -- and --.
Line 43: Change "end" to -- and --.

UNITED STATES PATENT AND TRADEMARK OFFICE

CERTIFICATE OF CORRECTION

PATENT NO. : 5,437,089
DATED : August 1, 1995
INVENTOR(S) : Salganik, et al.

It is certified that error appears in the above-identified patent and that said Letters Patent is hereby corrected as shown below:

Column 7,
Line 11: Change boldface "5" to boldface -- 3 --.
Line 16: At the end of the line, change "II" -- III --.
Line 41: Insert a comma after boldface "4".
Line 65: Insert a coma after "metal".

Column 8,
Line 8 , Insert a comma after the parenthesis.
Line 11: Change "its" to -- it -- and change "Leaves" to lowercase -- leaves --.
Line 28: Change "sad" to -- and --.
Line 34: Insert a comma after "During the second run".
Line 35: Change "lolling" to -- rolling --.
Line 39: Change "see" to -- are --.

Column 9,
Line 10: Insert a comma after "over".
Line 27: Change "event" to -- even --.
Line 34: Change "conditions" to -- condition --.
Line 36: Change italicized "$1_D$" to italicized -- $1_O$ --.
Line 42: Change "$V_{ni}$" to -- $V_{mi}$ --.

Column 10,
Line 21: Change "0.0l" to -- 0.1 -- and change "m/a" to -- m/s --.
Line 29: Change "Give" to -- Given --.
Line 63: Change "m/a" to -- m/s --.
Line 65: Change "m/a" to -- m/s --.
Line 68: Change "m/a" to -- m/s --.

Column 11,
Line 3: Change "m/a" to -- m/s --.
Line 6: Change "m/a" to -- m/s --.
Line 11: Change "line 1, page 14" to -- line 10 , column 8 --.
Line 13: Change "line 21, page 14" to -- line 30, column 8 --.
Line 15: Change "line 21, page 15" to -- line 64, column 8 --.
Line 17: Change "on page 16" to -- at line 37, column 9 --.
Line 19: Change "150a" to -- 150s --.
Line 24: Change "5a" to -- 5s --.

UNITED STATES PATENT AND TRADEMARK OFFICE

CERTIFICATE OF CORRECTION

PATENT NO. : 5,437,089
DATED : August 1, 1995
INVENTOR(S) : Salganik, et al.

It is certified that error appears in the above-identified patent and that said Letters Patent is hereby corrected as shown below:

Column 12,
Line 13: Insert after "portion" the following: -- $1_{01}$ of slab section $1_0$, --.
Line 20: Insert a period after "unwinding".
Line 31: Insert a period after "run".
Line 64: Insert -- =60/50 -- immediately before "=1.2 m/s" so that portion of the line reads: -- $1_2/\tau_3$ = 60/50=1.2m/s -- .
Line 67: Replace "$V_{u3}$ + $V_1$)/2 with -- $V_{u3}$=($V_{n3}$-$V_1$)/2 --.

Column 13,
Line 1: Replace "$V^7_{car3}$-" with -- $V^u_{car3}$ --.
Line 2: Insert -- (-- after "=" at beginning of line, and change "/l ==" to -- /2= --, so that the equation reads as follows: -- =($V_{u3}$+$V_1$)/2 = (1.2 + 0.1)/2 = 0.65 m/s --.
Line 12: Change "rosy" to -- may --.
Line 31: Insert -- fact that -- at the very beginning of the line, before "the intermediate coil".

Column 14,
Line 18: Change "protions" to -- portions --.
Line 35: Change "byt he" to -- by the --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*